US005720212A

United States Patent [19]

Kirkpatrick

[11] Patent Number: 5,720,212

[45] Date of Patent: Feb. 24, 1998

[54] LOCKING ARRANGEMENT FOR DIE CUTTER BLANKET

[75] Inventor: Alan D. Kirkpatrick, Martinsville, N.J.

[73] Assignee: Robud, Pinebrook, N.J.

[21] Appl. No.: 735,920

[22] Filed: Oct. 24, 1996

Related U.S. Application Data

[63] Continuation of Ser. No. 408,209, Mar. 22, 1995, abandoned.

[51] Int. Cl.[6] ..... B26D 7/20

[52] U.S. Cl. ..... 83/659; 83/347; 83/698.42

[58] Field of Search ..... 83/347, 659, 698.42; 492/45, 57, 59; 101/415.1; 24/287, 324, 455, 662; 403/278, 279, 282, 353

[56] References Cited

U.S. PATENT DOCUMENTS

| | | | |
|---|---|---|---|
| 3,537,632 | 11/1970 | Watson . | |
| 3,577,822 | 5/1971 | Sauer | 83/659 |
| 3,633,246 | 1/1972 | Kirkpatrick . | |
| 3,714,692 | 2/1973 | Bray . | |
| 3,739,675 | 6/1973 | Duckett et al. | 83/659 |
| 3,880,037 | 4/1975 | Duckett et al. | 83/659 |
| 3,882,750 | 5/1975 | Duckett et al. | 83/659 |
| 4,031,600 | 6/1977 | Whigham | 83/659 X |
| 4,073,207 | 2/1978 | Kirkpatrick | 83/347 X |
| 4,073,208 | 2/1978 | Kirkpatrick | 83/659 |
| 4,075,918 | 2/1978 | Sauer | 83/659 |
| 4,191,076 | 3/1980 | Bollmer et al. | 83/13 |
| 4,791,846 | 12/1988 | Kirkpatrick | 83/659 |
| 4,848,204 | 7/1989 | O'Connor et al. | 83/659 |
| 4,867,024 | 9/1989 | Cho et al. | 83/659 |
| 5,076,128 | 12/1991 | O'Connor et al. | 83/659 |
| 5,078,535 | 1/1992 | Kirkpatrick | 403/339 |

*Primary Examiner*—Eugenia Jones
*Attorney, Agent, or Firm*—William Squire

[57] ABSTRACT

A die cutter blanket covers an anvil roller and includes a polyurethane coating bonded to a sheet metal liner secured to an anvil roller channel by interlocking male and female locking portions secured to the blanket ends. The female locking portion comprises an end of the blanket coating depending from the blanket end and overlying a depending backing liner leg. Both are riveted to a first leg of an L-shaped member. An elastomeric element is secured to an end edge of the second leg via a tongue and groove and/or by bonding. The second leg and element are in interference compressive friction engagement with the channel. The male locking portion is interlocked to the inserted female portion. In other embodiments a separate compressible strip is secured in or formed part of the channel material to engage an end of the second leg. A further shim is in the channel or attached to the first leg and cooperates with the element to provide desired additional compressive frictional engagement with the channel.

20 Claims, 5 Drawing Sheets

LOCKING ARRANGEMENT FOR DIE CUTTER BLANKET

This application is a continuation of application Ser. No. 408,209 filed Mar. 22, 1995, abandoned.

This invention relates to locking devices for locking flexible elements, e.g., flexible die cutter blankets, for wrapping about a cylindrical rotary die cutter anvil.

Rotary die cutting relates to die cutting a moving workpiece, e.g., a continuously moving web of sheet material without interrupting the web movement. See for example, U.S. Pat. No. 5,078,535 incorporated by reference herein. Moving webs or discrete sheets of sheet material, e.g., cardboard or corrugated paperboard, are passed between a cutting roller and an anvil roller. Cutters are mounted on the cutting roller and rotate therewith. The anvil roller has a cylindrical cover referred to as a cutting die blanket which encircles the anvil roller. The rollers rotate about parallel axes and are displaced an amount such that the cutters penetrate the surface of the die cutting blanket during cutting of the sheet material web passing therebetween.

The blankets are flexible sheets which are wrapped about the anvil roller. The anvil roller which typically is metal, but in certain implementations is encased within a two piece slip cylindrical bearing, made of hard polyurethane, which in turn is then wrapped with a cutting die blanket, has a channel in a surface thereof extending parallel to the axis of rotation of the anvil roller. Where the bearing is present, the channel is formed in a surface thereof instead of in the metal anvil roller. See for example U.S. Pat. Nos. 5,076,128 and 4,073,208 incorporated by reference herein.

The blankets are molded of elastically deformable urethane or other materials, such as polyurethane, polyvinyl chloride, chlorinated butyl rubber and so on onto the surface of a liner, typically thin sheet metal, or thin fiber sheets, wire reinforced rubber and so on. The blanket is generally formed in sheets of about 60 inches long and from 8 to 12 inches wide, width w FIG. 5*a*. The anvil roller may be 110 inches long and 20 inches in diameter. To cover the roller, ten to twelve blankets are employed and wrapped about the roller, the blankets abutting one another edge to edge on the roller. See FIG. 5*a* herein wherein blankets 3 are wrapped about an anvil roller 5 and abut at their edges forming seams 7. The seams 7 circumscribe the anvil 5 in spaced locations along the roller length.

The blankets are secured to the roller by locking devices that engage the channel in the anvil roller surface. A major problem is that the blanket locking devices must permit the blankets to be assembled and removed from the anvil with minimum effort. The locking devices typically comprise interlocking male and female members secured to adjacent ends of the blanket. The interlocking male and female members are inserted into the channel typically by forcing the mating members together during insertion into the channel.

The female member is inserted first and secured to the anvil at the base of the channel by a bolt. See U.S. Pat. No. 5,078,535, FIG. 8, for an example of the use of such a bolt. Another arrangement for securing the female member in the channel uses ribs on the female member and undercut grooves in the channel as disclosed, for example, in U.S. Pat. No. 5,076,128. The female ribbed member is inserted endwise into the channel and grooves. This latter arrangement has not met with commercial success because the channel is specially designed with the grooves. A locking device design needs to take into consideration that blankets need to be installed in commercially available anvil rollers whose channels do not have such grooves and would be prohibitively costly to form such grooves therein.

Various locking devices for locking the ends of a blanket to a channel in the anvil roller are disclosed, for example, in U.S. Pat. Nos. 3,739,675; 3,882,750; 4,191,076; 3,633,246 and 4,867,024 among others.

A problem recognized by the present inventor with the widely used arrangements employing bolts is that the bolts are secured to mating threaded holes having fixed locations in the channel. Generally these fixed locations cause the blankets to have an annular seam centrally of the anvil roller axial length along axis 13, FIG. 5*a*. For example, in FIG. 5*a* seam 7' is centrally located on the roller 5 axial central plane 9. Often, two blanks may be formed from a single web or sheet to be die cut wherein the two blanks are separated by a centrally located cutter on plane 9. This cutter penetrates the seam 7' and axially separates the blankets 11 and 11' even with bolts present. This separation causes defective cutting of the webs.

Another problem recognized is that bolts are cumbersome to assemble and disassemble. Further, it is recognized that it would be desirable to use the channels in the prior art anvils that need replacement blankets without the use of bolts. This would speed the blanket assembly and disassembly process.

In some anvil arrangements, the anvils are axially oscillated to preclude the cutters from penetrating the same blanket at the same location to spread the wear over a wider area to prolong the life of the blankets. In FIG. 5*a*, the anvil roller 5 may be oscillated in directions 13 along axis 15 by apparatus not shown. The oscillation of the roller 5 causes the cutter in the plane 9 to penetrate the blankets 11 and 11' in the region 17. A problem is recognized by the present inventor when the cutting action occurs at the central blanket seam 7' fixed axially due to the presence of the bolts. This problem is that penetration of the two adjacent blankets at that seam 7' wears out two blankets simultaneously. This is wasteful and costly. A need is seen for a locking arrangement which can preclude the wearing of two adjacent blankets such as blankets 11 and 11'.

A locking arrangement according to the present invention for locking a flexible blanket about cylindrical anvil means rotatable about an axis, the anvil means having a channel in a surface thereof extending substantially parallel to the axis, comprises a flexible blanket having first and second ends; a member connected to the first end for insertion into the channel; compression means for securing the member to the anvil means in the channel in compressive interference friction engagement; and interlock means coupled to the first and second ends for locking the ends together.

By employing compressive interference fit friction engaging means to secure the blanket ends to the channel, no bolts are required. Replacement blankets can be secured to existing channels without modifying the existing channels. Also, because no bolts are used a simpler assembly and disassembly procedure is provided.

Further, the blankets can be located axially to preclude wear of two adjacent blankets at a seam therebetween. The seams can be axially positioned away from alignment with the cutter such that oscillation of the anvil roller causes only one blanket to be worn by a given cutter.

In accordance with one embodiment, the member is L-shaped having a pair of legs, the arrangement including means for securing one leg to the first blanket end, the other leg having an edge distal the one leg, the compression means including compressible means coupled to the edge at least when the edge is in the channel.

In a further embodiment, the compressible means comprises a compressible element secured to the edge.

In a still further embodiment, the anvil means comprises an incompressible cylindrical anvil and a compressible element secured to and about the anvil, the channel being formed in the compressible element, the compressible means comprising a projection member formed as one piece integral with the anvil means compressible element and extending in and along the channel.

In a further embodiment, the compressible means comprises a compressible element dimensioned to be secured to the anvil means in the channel.

IN THE DRAWING

Figure 1:
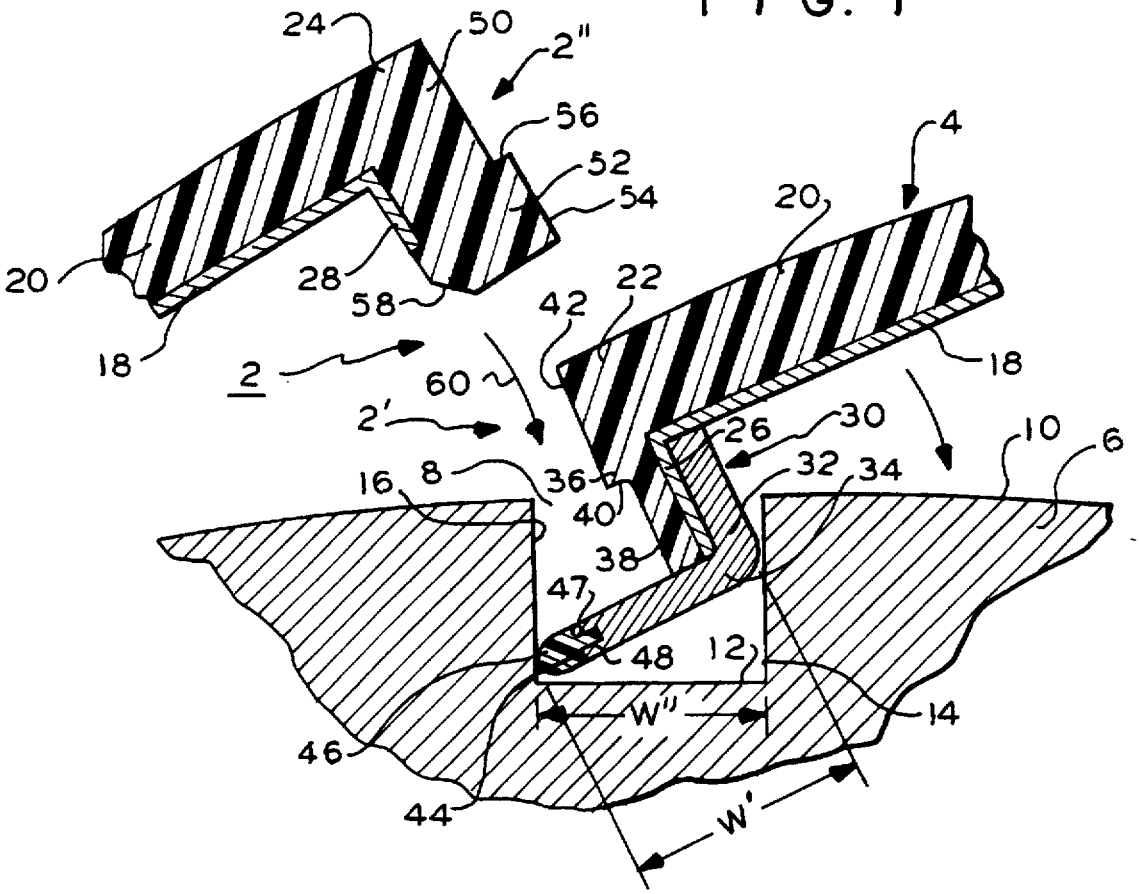
FIG. 1 is a side elevation fragmentary sectional view of a locking arrangement according to one embodiment of the present invention during assembly of the locking arrangement to an anvil roller locking channel.
Figure 2:
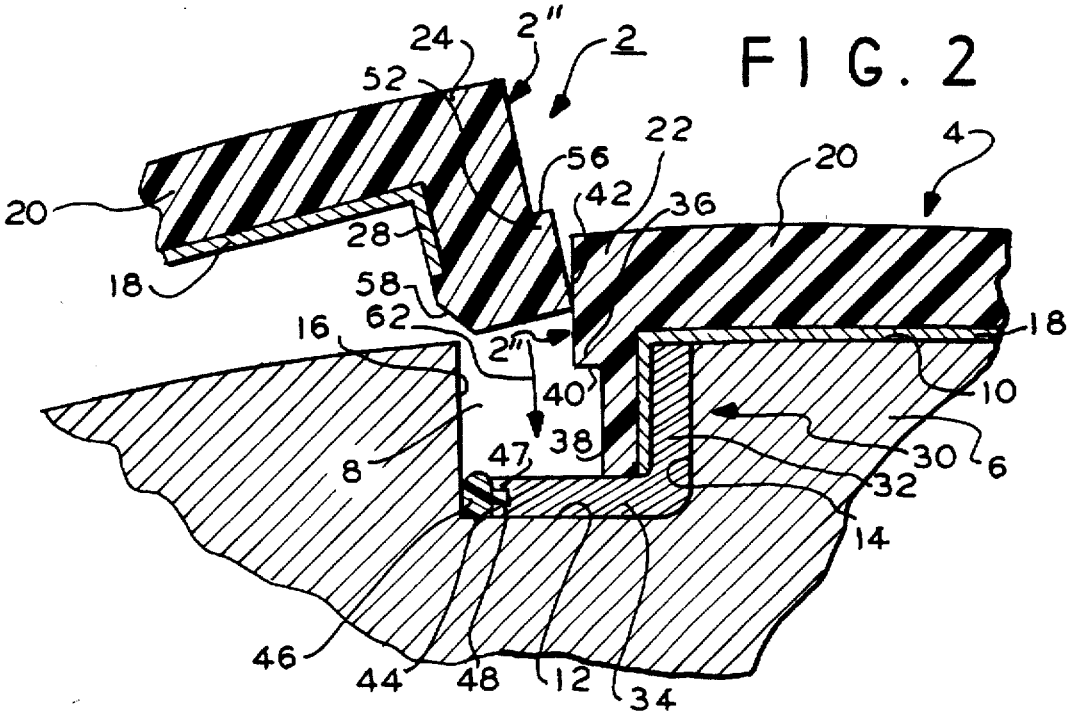
FIG. 2 is a view similar to that of FIG. 1 showing the locking engagement of the female locking portion to the anvil roller channel prior to locking of the male locking portion.
Figure 3:
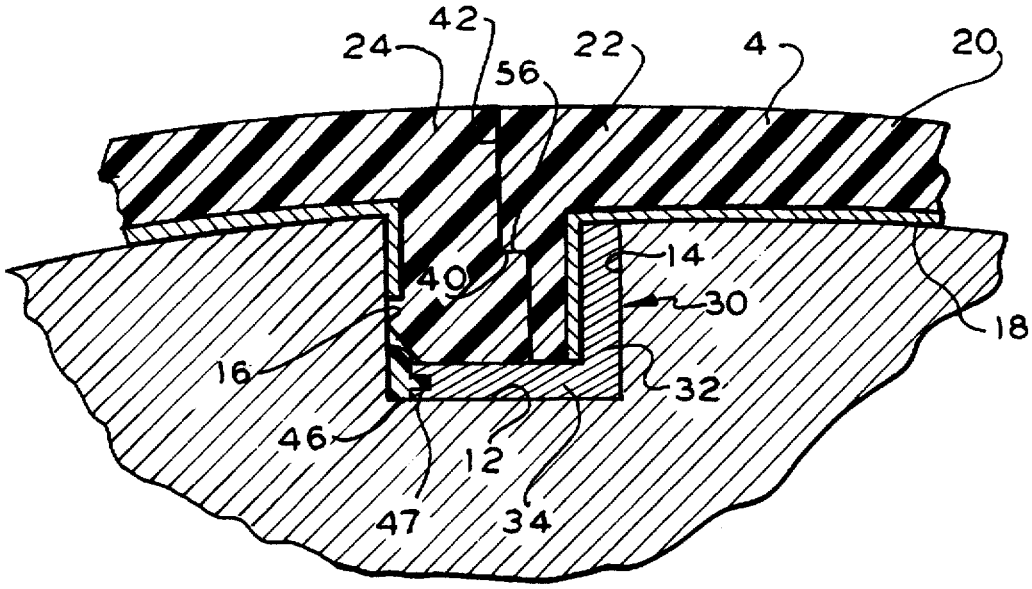
FIG. 3 is a view similar to that of FIG. 1 showing locking engagement of the male and female portions.
Figure 4:
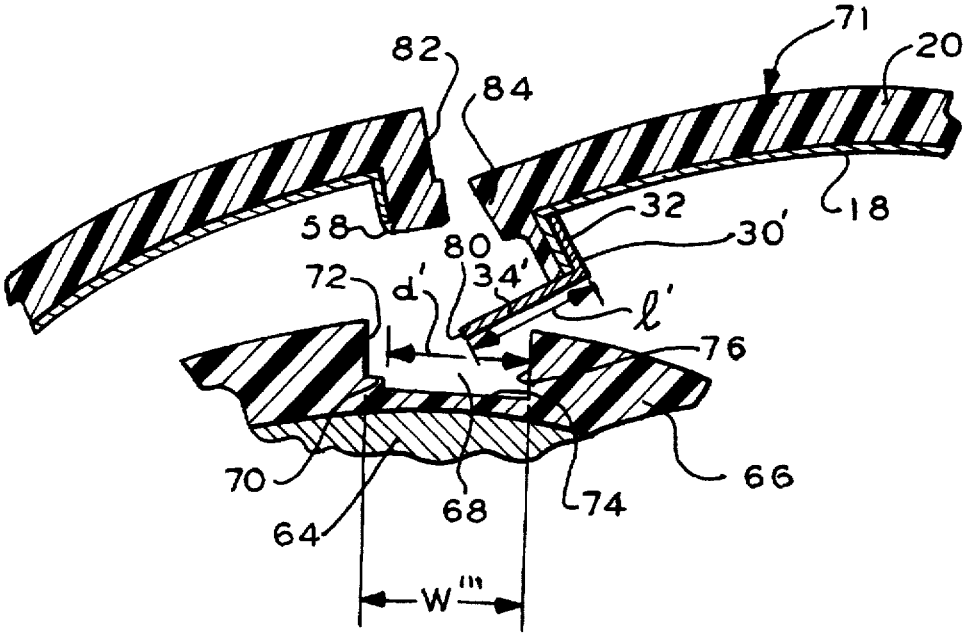
Figure 5A:
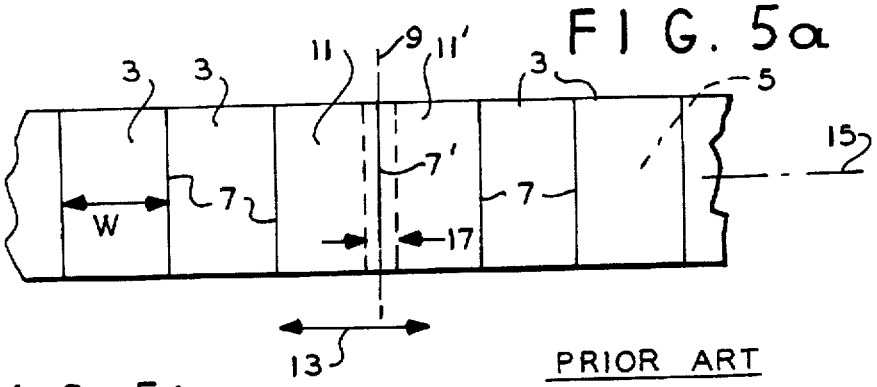
Figure 5B:
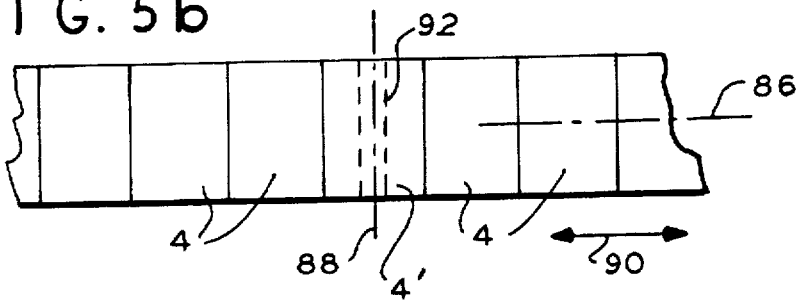
PRIOR ART FIG. 5b
Figure 6:
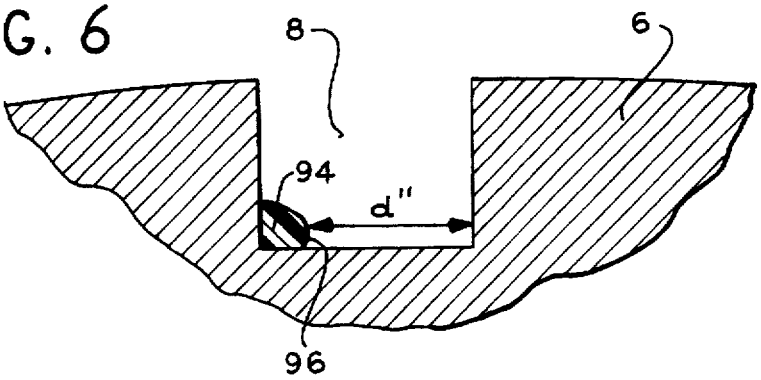
Figure 9:
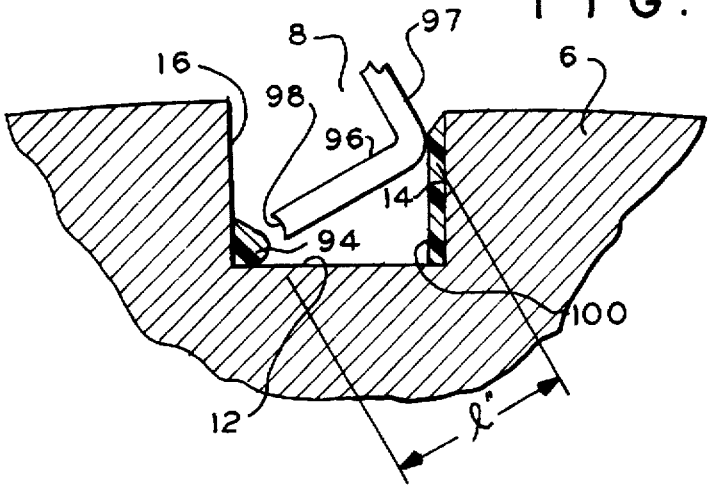
Figure 7:
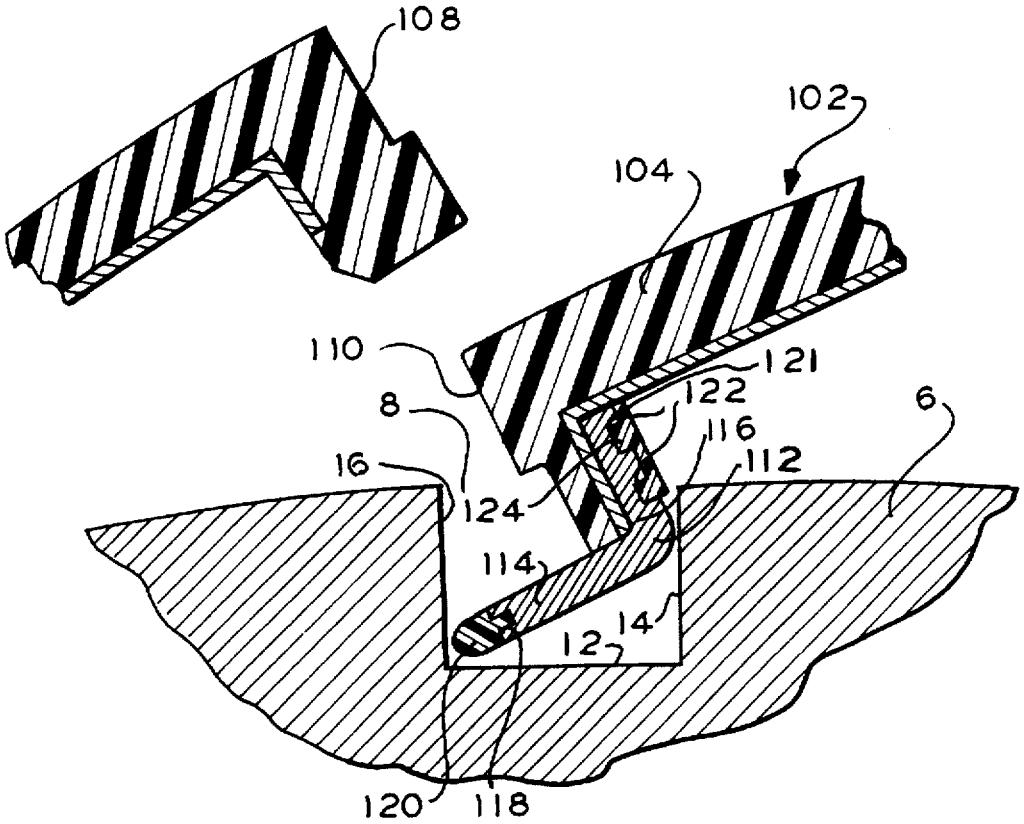
Figure 8:
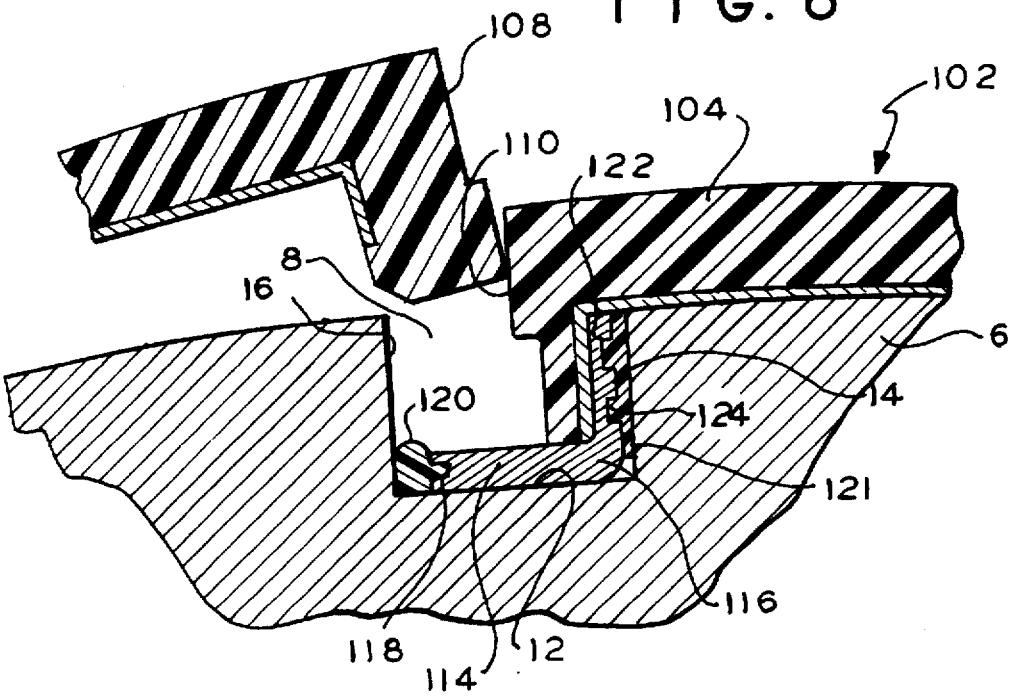
Figure 3A:
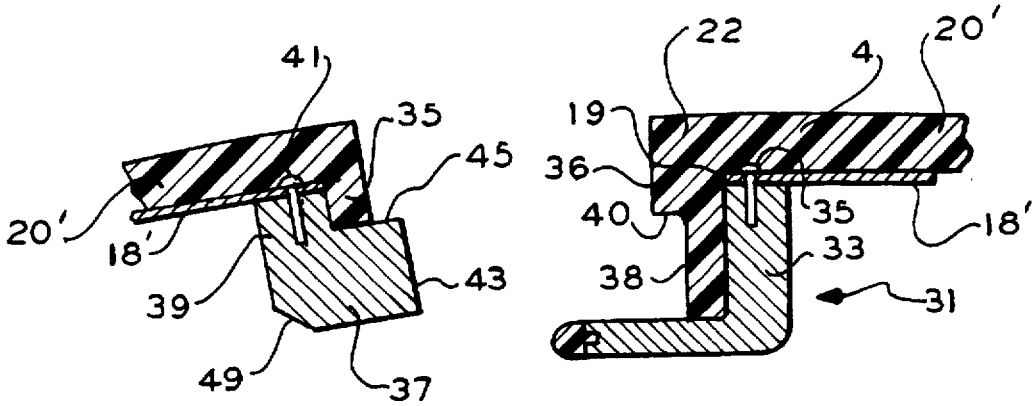
Figure 10:
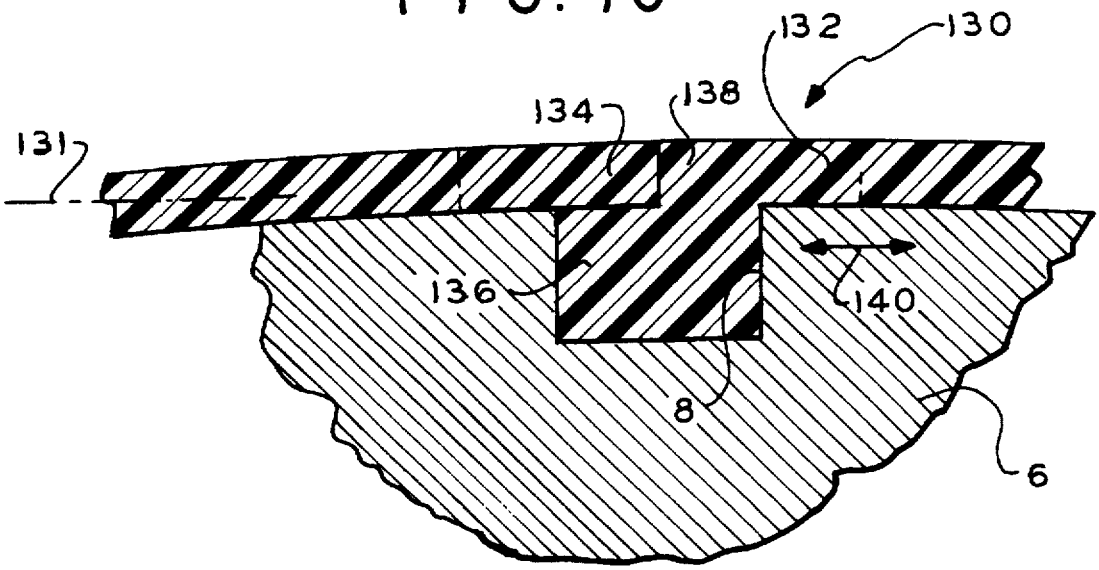

FIG. 3*a* is a view similar to FIG. 1 showing an alternative embodiment of the locking arrangement;

FIG. 4 is a side elevation fragmentary sectional view of a second embodiment of the present invention during assembly of the locking arrangement to the anvil roller;

FIG. 5*a* is a diagrammatic fragmentary plan view of a blanket covered anvil roller according to the prior art;

FIG. 5*b* is a diagrammatic fragmentary plan view of a blanket covered anvil roller employing a locking arrangement according to an embodiment of the present invention;

FIG. 6 is a side elevation fragmentary sectional view of an anvil roller according to a further embodiment of the present invention;

FIGS. 7 and 8 are side elevation fragmentary sectional views similar to the views of FIGS. 1 and 2, respectively, of a further embodiment of the present invention;

FIG. 9 is a side elevation fragmentary sectional view of an anvil roller according to a further embodiment of the present invention; and FIG. 10 is a side elevation fragmentary sectional view of an anvil and roller according to a further embodiment of the present invention.

In FIG. 1, locking arrangement 2 has a female portion 2' and a male portion 2". The arrangement 2 secures a flexible cutter blanket 4 to a rotary anvil roller 6 via channel 8 in the peripheral surface 10 of anvil roller 6. Not shown is the cutting roller disclosed for example in the aforementioned U.S. Pat. No. 5,078,535 incorporated by reference herein. A plurality of cutters (not shown) are secured to the periphery of the cutting roller. The cutters cut a web of material, e.g., cardboard or paperboard and the like which passes between the rollers. The cutting and anvil rollers rotate out of phase as disclosed in U.S. Pat. No. 4,073,208. The cutters radially penetrate the blanket 4 at different locations.

The channel 8 extends for the length of the roller 6 in the axial direction normal to the plane of the sheet of drawing. The channel 8 has a bottom wall 12 and two spaced side walls 14 and 16. The side walls are normal to the bottom wall and form either a square or rectangular channel in transverse section. This channel is typical in prior art anvil rollers.

Bolt holes not shown and not essential for the present invention may be formed in the anvil roller in the bottom wall 12. The blanket 4 locking arrangement 2 is secured to the channel 12 without the use of special grooves or bolts and thus permits relatively quick assembly and disassembly of the blanket 4 to the roller 6. A further advantage will be described below with respect to the problem addressed in FIG. 5*a*.

Blanket 4 comprises a liner 18 to which a cutter penetrating coating 20 is secured. Liner 18 is a relatively thin flexible sheet material and preferably comprises thin sheet metal forming a backing for the coating 20. The liner 18 may also be formed of other materials typically used for such backings such as thin fiber sheets, wire reinforced rubber and so on. The dimensions of the liner 18 and coating combination are determined by the dimensions of the mating anvil roller 6. Typically for a roller of 20 inch diameter the blanket 4 has a length of about 60 inches between ends 22 and 24 and generally a width into the plane of the drawing Figure of about 12 inches.

The coating 20 is formed from any known blanket materials such as polyurethane, polyvinyl chloride, chlorinated butyl rubber and so on and bonded to the liner 18. The coating thickness is typical as employed in prior art blankets.

The female portion 2' of the locking arrangement 2 is attached to end 22 and male portion is attached to end 24 of the blanket 4. At end 22, the liner 18 is bent with a depending leg 26 at right angles the plane of the remaining portion of the liner 18. A similar bent depending leg 28 is formed in the liner 18 at the blanket other end 24. Legs 26 and 28 extend for the entire width of the blanket 4.

The female portion 2' of the locking arrangement 2 includes a metal member 30, preferably aluminum or steel, having legs 32 and 34 at right angles to each other. The end 22 of the coating 20, which is flexible, is formed with a molded integral homogeneous one piece depending member 36. Member 36 extends for the entire width of the end 22 of the coating 20. Member 36 has a stepped surface 38 and a shoulder 40 between surface 38 and end 22 edge 40.

Member 36 is juxtaposed with the leg 26 of liner 18 and leg 32 of member 30. The member 36 is bonded to the leg 26 simultaneously with the bonding of the coating 20 to the liner 18 when bond cast. The leg 32 of member 30 is bonded or otherwise attached to the liner 26 and member 36, e.g., by rivets (not shown). The lower depending edges of the member 36 and leg 26 abut leg 34 of member 30.

The distal edge 44 of leg 34 is formed with a slot 46 which extends for the length of the leg 34 in a direction normal to the plane of the drawing figure. An elongated compressible element 46 has a tongue 48 which is bonded to and within the slot 47 for the entire slot length. The remainder of the element 46 has the same length and preferably the same thickness as leg 34 and an arcuate outer surface across the thickness opposite tongue 48. This thickness is preferably about 0.100 inches and is not critical. The element 46 is preferably formed of compressible material such as polyurethane, other compressible thermoplastics, rubber or compounds thereof or other elastomeric compressible high friction material. The element 46 and member 30 together form a composite structure.

The leg 34 with the element 46 attached has width w' which is greater than the width w" of the channel 8. This produces an interference fit of preferably about 0.020 to 0.060 inches between the leg 34 and attached element 46 with the channel 8 width w" when oriented as shown in FIG. 2. As a result, in this orientation, with the leg 34 and members 30 and 36 fully inserted into the channel 8 as in FIG. 2, the element 46 is squeezed and deformed as shown. This creates a friction load on the element 46 and attached leg 34 holding the member 36 and member 30 fully seated in place in the channel 8.

This holding action permits the male portion 2" of the locking arrangement 2 to be inserted into the channel 8 and interlocked to the female portion 2' while locking the interlocked portions 2' and 2" to the channel 8 as will be explained in more detail below.

The male locking portion 2" comprises a depending leg member 50 bonded to liner 18 leg 28 and juxtaposed therewith. Leg member 50 has a projection 52 with a surface 54 and a shoulder 56. Projection 52 has a chamfer 58 between its bottom surface and rear surface aligned with leg 28. The chamfer 58 and projection 52 extend for the full width of the blanket 4.

In operation, in FIG. 1, the female portion 2' is inserted in direction 60 with the element 46 inserted first as shown until it abuts the lowermost comer of the channel 8. The end 22 is then rotated in direction 60 forcing the leg 34 into the channel and squeezing the element 46 against the channel wall 16. The element 46 deforms as shown in FIG. 2 with the leg 34 fully seated in the channel 8. This deformation provides sufficient friction holding force for the portion 2' to hold this portion in the channel while the male portion 2" is then inserted in direction 62, FIG. 2.

The male portion 2" is inserted by pounding it into position, FIG. 3, direction 62, FIG. 2. This causes the projection 52 to seat in the recess formed by surface 38 and shoulder 40 interlocking the male portion 2" shoulder 56 to the female portion 2' shoulder 40. The male portion when so interlocked locks the blanket 4 to the channel 8. The friction forces of the interference fit of the element 46 and member 30 with the channel 8 side walls 16 and 14 and of the male and female portions 2" and 2', respectively, holds these structures in place during use of the anvil roller. The bulge of the compressed element 46 expands into the recess formed by the chamfer 58 of the male portion 2".

In the alternative to providing the liner 18 with a bent depending leg 26 of FIG. 3, in FIG. 3*a* liner 18' has an edge 19 which terminates at member 36. L-shaped metal member 31 has a leg 33 which abuts directly against the depending member 36. The leg 33 has a thickness greater than leg 32 of member 30, FIG. 3. The leg 33 is riveted to the liner 18' by a rivet 35 passing through the liner 18' into the end edge of the leg 33 parallel to the leg 33.

The leg 28 of liner 18 FIG. 3 is elimiminated in the alternative embodiment of FIG. 3*a*. In this embodiment, the blanket 20' terminates at its other end in a depending leg 35. A metal aluminum or steel for example L-shaped male locking member 37 has a leg 39 riveted to the liner 18' by rivet 41. The other leg 43 of member 37 is dimensioned to fit within recess formed by stepped surface 38 and shoulder 40. The leg 43 has a ledge 45 which engages shoulder 40 in the locked condition similar to that of FIG. 3. A chamfer 49 is formed on the lower corner of member 37 and functions similarly as chamfer 58 in the embodiment of FIG. 3.

The term compressive interference friction engagement as used in the claims does not necessarily require the compressible element to deform significantly. What is required is that there be sufficient interference fit such that the involved structures compressively deform sufficiently to frictionally hold these elements in place as described. For example, even slight interference fit in the order of a few thousandths of an inch with relatively hard materials may be sufficient to provide the necessary frictional holding forces for the purpose desired, e.g., to preclude axial displacement of the blanket in the presence of cutting loads. It is known, for example, that metal-to-metal interference fit can produce significant friction holding forces, even where the order of magnitude of interference fit is within a few thousandths of an inch.

In analternative embodiment, in FIG. 4, anvil roller 64 is wrapped with a polyurethane bearing 66, which is compressible, but described in the aforementioned U.S. Pat. No. 5,076,128 as hard material. These structures are generally shown in U.S. Pat. No. 5,076,128 incorporated by reference herein. However, channel 68 is different than the grooved channel disclosed in the aforementioned patent. Channel 68 has no corresponding grooves, but has a step projection 70 in the lowermost corner of the channel between side wall 72 and bottom wall 74. The side walls 72 and 76 and bottom wall 74 of the channel 68 are otherwise planar and normal as shown and extend for the width of the roller 64 as does the projection 70.

The channel 68 width w"' corresponds to and may be the same as width w", FIG. 1, of the channel 8. The member 30' is substantially identical to the member 30 of FIG. 1 except there is no slot in the end edge 80. Leg 34' has a length 1' which is in interference fit in the region between step projection 70 and channel wall 76. Because the material of the bearing 66 may be harder than that of element 46, FIG. 1, the extent of interference may be less than that described for the embodiment of FIG. 1. The projection 70 thus replaces the compressible element 46 of the embodiment of FIG. 1. While the projection 70 may be of harder material than that of element 46, it is sufficiently compressible to provide the desired friction loading to hold the female locking portion in place.

The male locking portion 82 of blanket 71, FIG. 4, may be identical to the male locking portion of the blanket 2, FIG. 1. The female locking portion 84 otherwise may also be identical to the female locking portion 2', FIG. 1. However, some dimensional differences may be necessary. For example, the member 30' leg 34' may have a different dimension 1' due to the difference in compressibility of the bearing 66 and the element 46 of FIG. 1. When the leg 34' is fully inserted in the channel 68 abutting the projection 70, the projection 70 may bulge somewhat and expand into the recess formed by chamfer 58 on the male portion 82. What is important is that the projection 70 deforms in response to compression and does not exhibit fatigue failure, e.g., cracks. Therefore, brittle or low friction material is not desirable for the compressible element.

Because no bolts are used to lock the blanket 4, FIG. 1, or blanket 71, FIG. 4, to the corresponding channel 8 and 68, respectively, the blankets can be placed anywhere along the axial length of the anvil roller such as roller 6, FIG. 1, or roller 68, FIG. 4. In FIG. 5*b*, for example, blankets 4 can be axially positioned along axis 86 so that no seam between adjacent blankets lies on cutting plane 88. Thus the central blanket 4' lies centrally on plane 88 and oscillation of the roller in directions 90 causes the central web parting cutter (not shown) to penetrate only the blanket 4' in the region 92 when the anvil roller is oscillated in directions 90.

In FIG. 6, a further alternative embodiment is illustrated. An anvil roller 6 which may be identical to roller 6, FIG. 1, has a typical prior art channel 8. The blanket used in this embodiment may also be identical to the blanket 4, FIG. 1. However, some dimensional changes may made to the member 30, leg 34 width dimension as well as elimination of the slot 47, FIG. 1, in accordance with a given implementation.

In FIG. 6, an elastomeric strip 94 is placed in a lowermost corner of the channel as shown. The strip 94 may be thermoplastic, e.g., polyurethane, rubber or other compressible material. The strip 94 extends in the channel 8 for the axial length of the roller 6. The strip 94 preferably has an arcuate surface 96, but this is not essential. A blanket configured as blanket 71, FIG. 4 is used in this embodiment. The leg 34' of the member 30' of the female locking portion of blanket 71 has no slot at its end edge.

In FIG. 9, L-shaped member 97 has a leg 96 which overlies and abuts the wall 12 of channel 8 when fully inserted in the channel. The leg 96 has an arcuate concave end edge 98 to accommodate the convex curvature of the strip 94. A thermoplastic or other compressible sheet material shim 100 is bonded to side wall 14 of channel 8 along the length of the channel. The shim 100 may be uniform in thickness, which is not essential, and sufficiently thick to provide the desired compressive friction loading on the member in this embodiment.

The shim 100 may be made of any suitable material to provide such compressive friction loading on the member 97. The leg 96 has a width dimension l" that is shorter than that of the leg 34', FIG. 4, width l' to accommodate the narrower width produced by the combination of the strip 94 and shim 100. The shim 100 induces further compressive friction loading on the member 98 inhibiting the removal of the member 98 from the channel 8 once locked in place.

In FIGS. 7 and 8, a further embodiment is illustrated in which a blanket 102 has a coating 104 which may be identical to coating 20, FIG. 1. A locking arrangement 106 includes male portion 108 which may be identical with portion 2", FIG. 1 and a female portion 110. The female portion 110 except for member 112 may be identical to portion 2', FIG. 1.

Member 112 is L-shaped with two legs 114 and 116. Leg 114 has a slot 118 in the end edge. An elastomeric or otherwise compressible strip element 120 has a tongue which is bonded in slot 118. The strip element 120 has a convex end surface and extends for the length of the roller 6. An elastomeric or otherwise compressible shim member 121 is attached to leg 116 at a surface facing wall 14 of the channel 8 when inserted in the channel.

The leg 116 preferably has a pair of parallel grooves 122 in the surface thereof. The member 121 preferably has a pair of parallel ridges 124 which mate in a corresponding groove 122 and bonded therein. The member 121 projects beyond the leg 116 so as to engage the channel 8 wall 14 in compressive interference fit therewith. The member 121 and element 120 both compress, FIG. 8, to provide frictional engagement with the respective channel walls 14 and 16 when the female portion is fully seated as shown. The male portion 108 is then interlocked with the female portion as described above in connection with the embodiment of FIG. 3.

In FIG. 10, in a further embodiment, anvil roller 6 has channel 8 as described above. Blanket 130 is formed of materials as described for blanket 20, FIG. 1. Blanket 130 is arranged with interlocking fingers 132 and 134 which lie in the plane 131 of the blanket and coextensive therewith. Such fingers are shown for example in U.S. Pat. No. 4,791,846 incorporated by reference herein. However, in this patent movement is permitted between the blanket and the anvil head during operation. In the present embodiment such relative movement is not desired.

To lock the blanket 130 in place to preclude relative movement to the anvil roller 6, a locking projection 136 depends from end 138 of blanket 130. The projection 136 depends from the fingers 132 and 134. The projection is integral with and is one piece with the blanket 130. The projection 136 is of the same shape as the channel 8 and extends for the length of the channel 8 into and out of the drawing figure. The projection 136 is dimensioned to fit in interference compressible friction engagement fit with the channel 8 in the transverse directions 140. This fit locks the projection and the blanket to the anvil roller 6 precluding axial displacement of the blanket 130 relative to the anvil roller.

It will occur to one of ordinary skill that various modifications may be made to the disclosed embodiments without departing from the scope of the invention as defined in the appended claims. The disclosed embodiments are given by way of illustration and not limitation.

What is claimed is:

1. A blanket for mounting on a cylindrical anvil means rotatable about an axis, the anvil means having a channel in a surface thereof extending substantially parallel to said axis, said channel having opposing side walls, said blanket comprising:

a flexible strip having first and second ends, said flexible strip for wrapping about said anvil means so that the first and second ends are adjacent to each other;

a locking member having opposing surfaces and disposed on the first end for insertion into said channel and for locking said first end to said anvil means;

compression means comprising at least one compression member secured to the locking member on one of the surfaces for engaging one of said side walls for locking the locking member and said first end of the strip to the anvil means by compressive interference friction engagement with said channel; and interlock means disposed on the first and second ends for locking said ends together.

2. The blanket of claim 1 wherein the member is L-shaped having a pair of legs and including means for securing one leg to the first end, the other leg having an edge distal to the one leg, the compression means including a compressible element coupled to the edge.

3. The blanket of claim 1 wherein the compression means comprises a compression element and means for securing the compression element to said anvil means in said channel.

4. The blanket of claim 1 wherein said compression means and said locking member form a composite member for engaging the channel in interference fit.

5. The blanket of claim 1 wherein the interlock means comprises a first locking element of compressible material formed with a stepped surface having a shoulder, the first locking element depending from the first end and a second locking element secured to the second end and having a projection extending beyond the second end for engaging the stepped surface and shoulder, the projection and stepped surface for locking the projection to the shoulder in said channel.

6. The blanket of claim 5 wherein the member is L-shaped including a first leg juxtaposed with the first locking element and a second leg normal to the first leg, said compression means for compressive engagement with said second leg and at least one of said side walls.

7. A blanket for mounting on a cylindrical anvil means rotatable about an axis, the anvil means having a channel in a surface thereof and extending substantially parallel to said axis, said channel having spaced side walls and a bottom wall, said blanket comprising:

a flexible strip having first and second ends for wrapping about said anvil means so the first and second ends are adjacent to each other;

an L-shaped locking member having first and second legs and disposed on the first end for insertion into said channel, the first leg for overlying a first of said channel side walls and the second leg for overlying the bottom wall, the second leg having an edge distal to the first leg;

compression means comprising a compressible member coupled to the locking member for compressive interference engagement with one of said channel side walls and with said locking member edge for locking the L-shaped member to said anvil means by compressive interference friction engagement; and interlock means secured to the first and second ends for locking said ends together.

8. The blanket of claim 7 wherein the compressible member is secured to the edge.

9. The blanket of claim 7 wherein the compression means comprises a compressible shim juxtaposed with the first leg for overlying one of said channel side walls.

10. The blanket of claim 7 wherein said side walls are normal to said bottom wall, the second leg for being normal to said side walls.

11. The blanket of claim 7 wherein said L-shaped member is incompressible.

12. The blanket of claim 11 wherein the interlock means comprises a first depending portion at the first end juxtaposed with and secured to the first leg, a recess being in said first depending portion, said second end having a second depending portion with projection means for engagement with said recess for locking said second end to the first end.

13. A blanket for mounting on a cylindrical anvil means rotatable about an axis, the anvil means having a channel in a surface thereof extending substantially parallel to said axis, said channel having opposing side walls, said blanket comprising:

a flexible strip having first and second ends, said flexible strip for wrapping about the anvil means such that the ends are adjacent to each other;

a locking member connected to the first end for insertion into said channel and for locking said first end to said anvil means;

compressible means coupled to the locking member, said locking member and compressible means for compressive interference engagement with and between said channel side walls for locking the locking member and said first end of the strip to the anvil means in compressive interference friction engagement with the channel side walls; and interlock means for locking said ends together.

14. The locking arrangement of claim 13 wherein said member depends from the first end, the interlock means comprising projection means connected to the first and second ends for insertion into said channel.

15. A blanket and anvil arrangement comprising:

a cylindrical anvil means rotatable about an axis, the anvil means having a channel in a surface thereof extending substantially parallel to said axis;

a flexible strip having first and second ends for wrapping about the anvil means such that the first and second ends are adjacent to each other;

an L-shaped member having a pair of legs and connected to the first end and located in said channel;

interlock means coupled to the first and second ends for locking said ends together; and means for securing one member leg to the first end, the other member leg having an edge distal to the one leg;

said anvil means comprising an incompressible cylindrical anvil and a compressible element secured to and about the anvil, the compressible element being formed with said channel, said compressible element including a compressible projection member formed as one piece integral with the anvil means compressible element in the channel for securing the L-shaped member within the channel to the anvil means in compressive interference friction engagement.

16. A blanket for mounting on a cylindrical anvil means rotatable about an axis, the anvil means having a channel in a surface thereof extending substantially parallel to said axis, said channel having opposing side walls, said blanket comprising:

a flexible strip having first and second ends, said strip for wrapping about said anvil means such that the first and second ends are adjacent to each other;

a member connected to the first end for insertion into said channel;

compression means coupled to the member for securing the member within the channel to the anvil means in compressive interference friction engagement with the channel; and interlock means coupled to the first and second ends for locking said ends together;

said member having opposing surfaces, the compression means comprising at least one compressible member secured to at least one of said surfaces for engaging one of said side walls.

17. A blanket and anvil arrangement comprising:

cylindrical anvil means rotatable about an axis, the anvil means having a channel in a surface thereof extending substantially parallel to said axis, said channel having opposing side walls;

a flexible strip having first and second ends;

a member connected to the first end and located in said channel;

compression means for securing the member within the channel to the anvil means in compressive interference friction engagement; and interlock means coupled to the first and second ends for locking said ends together;

the interlock means comprising a first locking element of compressible material formed with a stepped surface having a shoulder, the first locking element depending from the first end and a second locking element secured to the second end and having a projection extending beyond the second end for engaging the stepped surface and shoulder, the projection and stepped surface for locking the projection to the shoulder;

said member being L-shaped with a first leg juxtaposed with the first locking element and a second leg normal to the first leg, said compression means being compressively engaged by and between said second leg and at least one of said side walls.

18. A blanket for mounting on a cylindrical anvil means rotatable about an axis, the anvil means having a channel in a surface thereof and extending substantially parallel to said axis, said channel having spaced side walls and a bottom wall, said blanket comprising:

a flexible strip for wrapping about said anvil means and having first and second ends;

an L-shaped member having first and second legs, the member being connected to the first end for insertion into said channel, the first leg for overlying a first of said channel side walls and the second leg for overlying the bottom wall;

compression means coupled to the L-shaped member for securing the member to the anvil means in said channel by compressive interference friction engagement of the compression means with said anvil means and with said member; and interlock means secured to the first and second ends for locking said ends together;

said second leg having an edge distal to the first leg, the compression means comprising a compressible member for insertion into the channel and for engaging a channel side wall and the edge in said interference friction engagement.

19. A blanket for mounting on a cylindrical anvil means rotatable about an axis, the anvil means having a channel having opposing side walls in a surface thereof extending substantially parallel to said axis, said channel having a width of a first value between said side walls transverse the axis, said blanket comprising:

a flexible strip having first and second ends, said flexible strip for wrapping about said anvil means so that the first and second ends are adjacent to each other;

a locking member disposed on the first end for insertion into said channel and for locking said first end to said anvil means, the locking member comprising a rigid member for engaging one of said side walls;

a compressible member secured to the locking member for engaging the other of said side walls, said locking member and compressible member having a combined dimension greater than said first value for compressive interference friction engagement with said channel side walls for locking the locking member and said first end of the strip to the anvil means side walls by compressive interference friction engagement with said side walls; and interlock means disposed on the first and second ends for locking said ends together.

20. A blanket and arrangement for mounting the blanket on a cylindrical anvil means rotatable about an axis, the anvil means having a channel in a surface thereof extending substantially parallel to said axis, said channel having opposing side walls, said blanket and arrangement comprising:

said blanket comprising:

a flexible strip having first and second ends, said flexible strip for wrapping about said anvil means so that the first and second ends are adjacent to each other;

a locking member having opposing surfaces and disposed on the first end for insertion into said channel; and interlock means disposed on the first and second ends for locking said ends together; and compression means for compressive interference engagement with one of said locking member opposing surfaces and one of said channel side walls for locking the locking member and said first end of the strip to the anvil means.

* * * * *